United States Patent [19]

Gapper et al.

[11] 4,062,593

[45] Dec. 13, 1977

[54] MINING MACHINES

[75] Inventors: Terence John Gapper, Duffield; Owen O'Neill, Littleover, both of England

[73] Assignee: Coal Industry (Patents) Limited, London, England

[21] Appl. No.: 660,814

[22] Filed: Feb. 24, 1976

[30] Foreign Application Priority Data

Mar. 20, 1975 United Kingdom ..... 11622/75

[51] Int. Cl.[2] ..... E21C 35/12

[52] U.S. Cl. ..... 299/1

[58] Field of Search ..... 299/1

[56] References Cited

U.S. PATENT DOCUMENTS

| | | | |
|---|---|---|---|
| 3,371,964 | 3/1968 | Weber | 299/1 |
| 3,817,578 | 6/1974 | Wilson | 299/1 |

FOREIGN PATENT DOCUMENTS

| | | | |
|---|---|---|---|
| 1,132,765 | 11/1968 | United Kingdom | 299/1 |
| 1,047,782 | 11/1966 | United Kingdom | 299/1 |

*Primary Examiner*—Ernest R. Purser

*Attorney, Agent, or Firm*—Stevens, Davis, Miller & Mosher

[57] ABSTRACT

A linear potentiometer is attached to the ranging arm of a ranging arm shearer such that it slides on the upper flange of the face conveyor to sense the height of the cutter drum relative to the conveyor.

5 Claims, 5 Drawing Figures

FIG.1

MINING MACHINES

This invention relates to mining machines and in particular to mining machines including cutter means carried on pivotally mounted booms or arms.

One known such mining machine is commonly called a ranging drum shearer and comprises at least one rotary cutter drum carried on an arm pivotally mounted on the machine body. The arm is pivoted about its pivotal mounting by a hydraulic jack which controls the angular position of the arm to raise or lower the cutter drum to a desired height. In coal mining practice a machine having a single rotary cutter traverses to and fro on an armored face conveyor arranged along a working face winning a strip of coal from the working face every two traverses. The thickness of coal won on each strip is typically somewhat less than twice the cutting diameter of the cutter drum so that on one traverse the machine wins coal adjacent the mine roof and on the following traverse wins coal adjacent to the mine floor.

With one prior known ranging drum shearer the cutter drum is raised or lowered to steer the machine by an operator who has to estimate the cutting horizon of the cutter drum. As the operator is remote from the cutter drum which is surrounded by dust generated during cutting, the steering is often erratic resulting in roof and/or floor rock being mined or in an excessive amount of coal being left unmined.

Techniques have been proposed for automatically steering ranging drum shearers using well known systems developed with fixed drum shearers i.e. machines having the axis of the cutter drums fixed with respect to the machine body. However, because of the problems encountered with determining the vertical position of the ranging cutter drum when cutting the lower strip of coal with respect to the mine floor formed on the previously won level strip the proposed techniques have not yet been fully developed.

An object of the present invention is to provide an improved ranging drum machine which overcomes or reduces the above mentioned problems.

According to the present invention a mining machine adapted to traverse to and fro on an armored and face conveyor along a working face, comprises a body adapted to move on a track fixed with respect to the conveyor, an arm which is pivotally mounted on the body for movement about an axis and which is adapted to support a cutter head remote from said axis, and a sensor arranged to sense the distance between the cutter head and the conveyor and to derive a signal indicative of the distance.

Preferably, the cutter head is a rotary cutter head and the sensor is arrangeable to sense the distance between the axis of rotation of the rotary cutter head and the conveyor.

Conveniently, the sensor is telescopic and is carried on the arm, the sensor including a base pad slidable on the conveyor.

Advantageously, the sensor includes a potentiometer arranged to sense the effective length of the sensor and to feed a signal indicative of the effective length to a steering control mechanism on the machine.

By way of example only, one embodiment of the present invention will be described with reference to the accompanying drawings in which.

Figure 1:
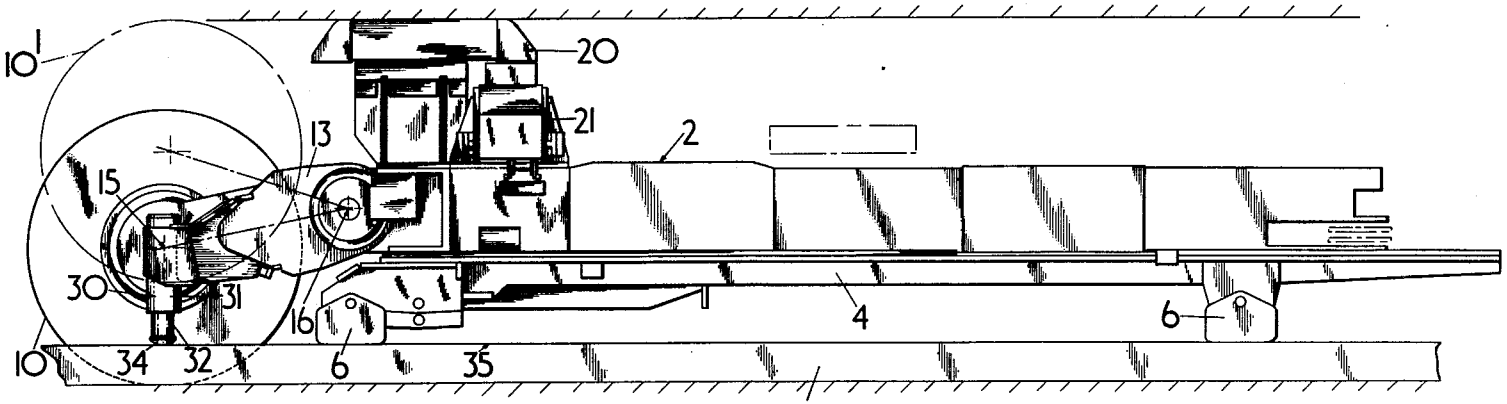
FIG. 1 is a side view of a mining machine constructed in accordance with the present invention.
Figure 2:
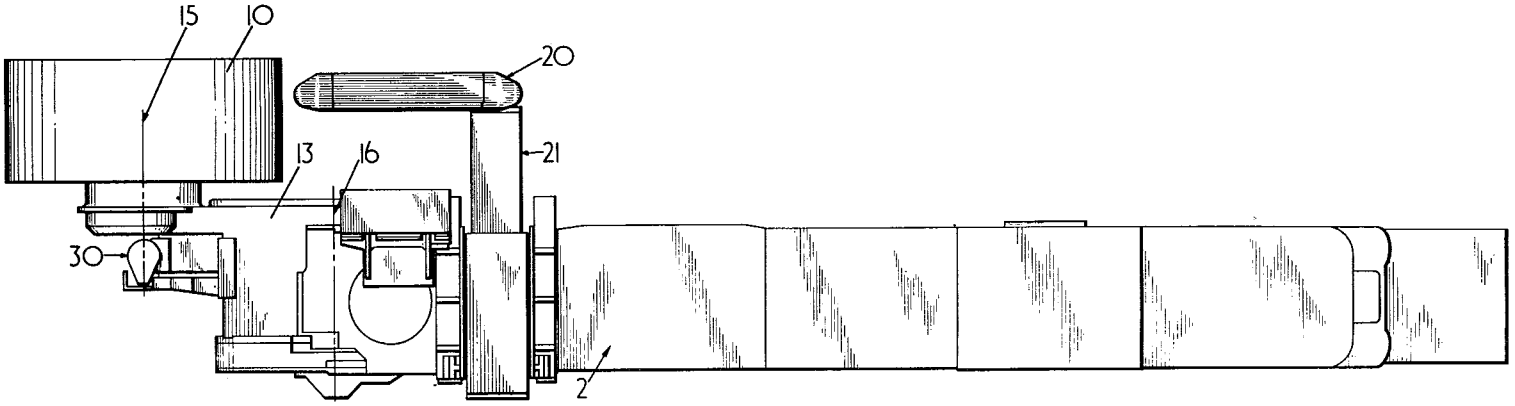
FIG. 2 is a plan of FIG. 1.

FIGS. 1 and 2 show a ranging drum shearer coal mining machine movably mounted on a track including an armored face conveyor 1 arranged along a longwall coal face. The track is not shown in FIG. 2. The machine comprises a body 2 including drive motor and gear sections and a control section carried on a support underframe 4 having shoes 6 for engaging the track.

A rotary cutter drum 10 is mounted on an arm 13 for rotation about an axis 15, the drum being driven by gearing extending within the arm and drivably connected to a shaft (not shown) supported by the machine body and being in turn drivably connected to drive mechanism situated within the body. The arm 13 is pivotally mounted on the body 2 for movement about an axis 16, pivotal movement of the arm being controlled by a hydraulic jack (not shown).

The arrangement is such that as the machine traverses along the face in one direction the cutter drum is raised to the mine roof indicated by 10' in FIG. 1 and as the machine traverses along the face in the opposite direction the cutter drum is lowered to the mine floor indicated by 10 in FIG. 1.

A nucleonic sensing probe 20 is mounted on the machine to sense the mine roof, the probe being carried on a telescopic arm 21 which forms the subject matter of the assignee's prior U.S. Pat. No. 3,984,147 issued Oct. 5, 1976. The probe 20 senses the mine roof to determine the thickness of a coal band left adjacent to the upper rock seam boundary and to feed a signal indicative of the coal band thickness to control means in the control section within the machine body 2 which controls the steering of the machine. The control means also receive and act on signals indicative of other parameters associated with the position of the cutter drum to ensure that the cutter drum is maintained on a desired cutting horizon. The parameters include the height of the cutter drum relative to a reference plane extending longitudinally of the machine.

When the machine is traversing along the face with the cutter drum in its lower position forming the mine floor the parameters sensed and monitored on previous traverses are used to steer the cutter drum in order that a desired mine floor profile is formed. In order to overcome the problems associated with undulations in the machine's track and with the fact that the cutter drum is somewhat remote from the shoes which engage the track it is necessary to sense the distance of the cutter drum axis rotation with respect to the conveyor. Thus, it is possible to maintain the cutter drum at a desired height relative to the mine floor formed on previous traverses of the machine.

Figure 3:
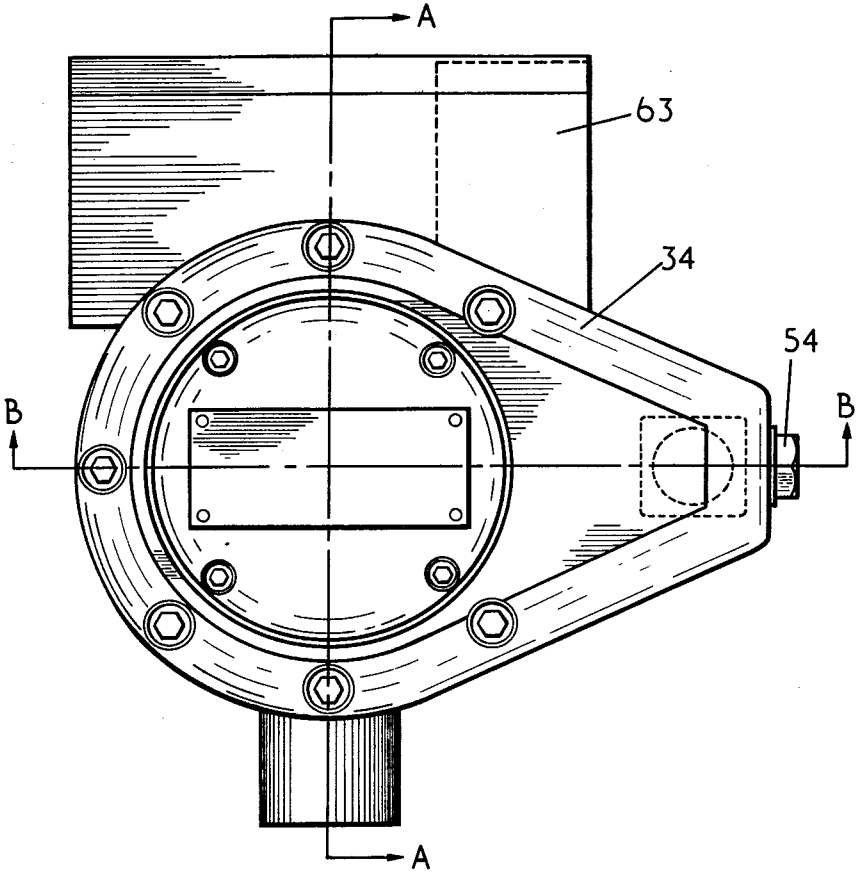
FIG. 3 is a detail of FIG. 2 drawn on an enlarged scale.
Figure 4:
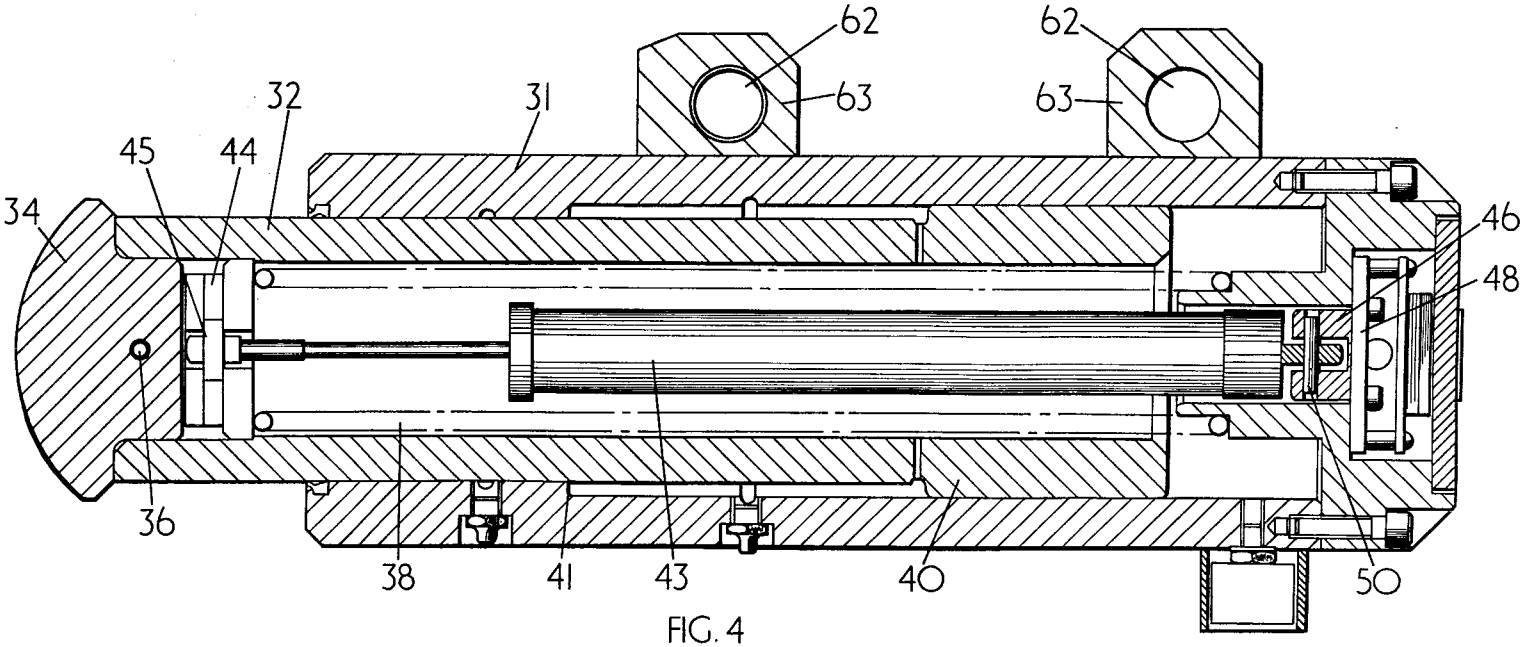
FIG. 4 is a section along line "A—A" of FIG. 3.
Figure 5:
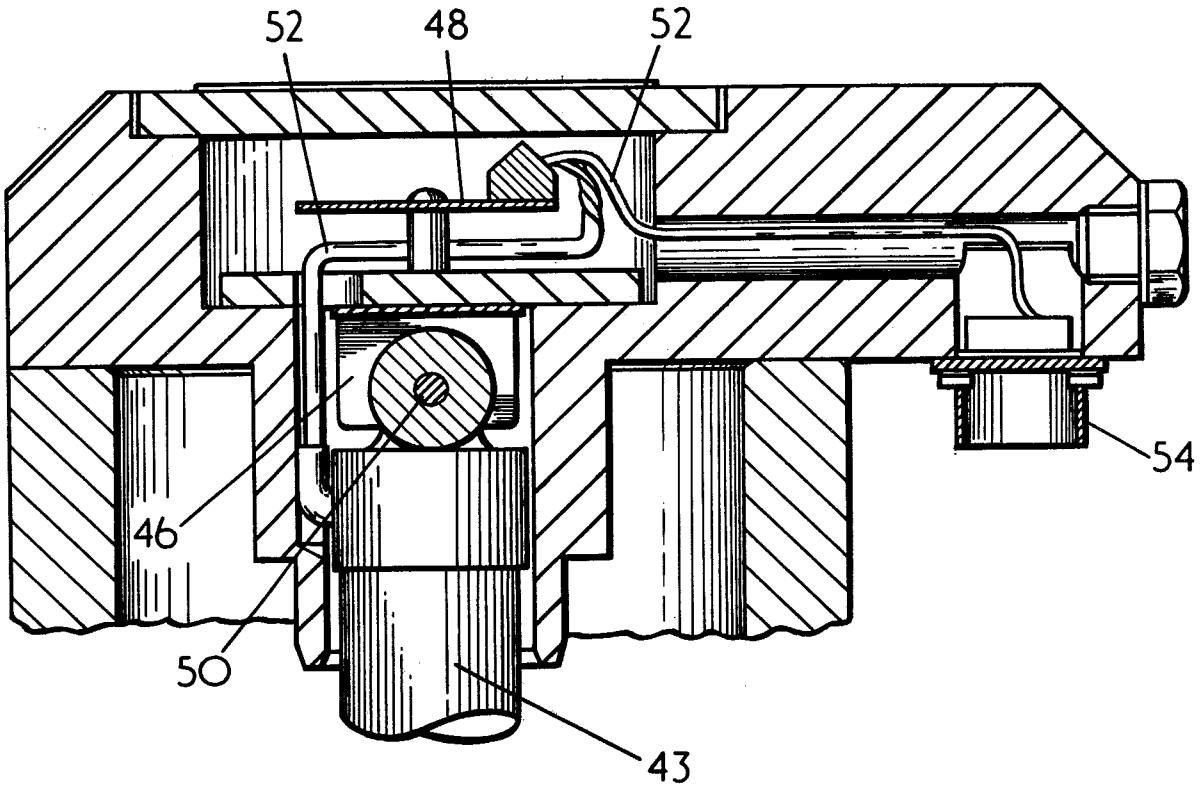
FIG. 5 is an incomplete section along line "B—B" of FIG. 3.

A sensor 30 to sense the height above the conveyor of the cutter head axis during machine traverses when the cutter head is forming the mine floor is mounted on the arm 13. The sensor 30 (which is shown in more detail in FIGS. 3, 4 and 5) comprises a telescopic assembly including an upper cylinder 31 and a downwardly extending rod 32 provided at its lowermost end with a domed shaped pad 34 slidable along an upper conveyor flange 35 and retained on the rod by a pin 36. The rod 30 is urged out of the cylinder by a spring 38, outward movement of the rod being limited by a shoulder 40 on the rod abutting a shoulder 41 on the inside bore of the cylinder. The effective length of the telescopic assembly as the rod moves into or out of the cylinder is sensed by a potentiometer 43 mounted between an attachment element 44 having a recess for accommodating the end of the potentiometer and a cross bore for a securing pin 45 and an attachment element 46 secured to a circuit board assembly 48. The attachment element 46 has a recess for accommodating the end of the potentiometer and a cross bore for a securing pin 50. The potentiometer is electrically connected to the circuit board assembly which feeds an electric signal indicetive of the effective length of the telescopic assembly along cables 52 to a socket 54 and hence along further cables (not shown) to the steering control section within the machine body.

The cylinder 31 is fixedly secured to the arm 13 by bolts engaging in bolt holes 62 formed in brackets 63.

Thus, during use as the machine traverses along the face with the cutter drum in its lowermost position forming the mine floor, the sensor 30 senses the height of the cutter drum axis above the conveyor and derives a signal indicative of this distance. The signal is fed to the machine's steering control means which thereby are able to adjust the cutting horizon of the cutter head to take account of indulation in the machine's track and maintain the height between acceptable limits. Thus if the derived signal indicates that the height of the cutter drum axis is more or less than a predetermined distance above the conveyor, the inclination of the arm 13 is suitably adjusted to maintain the distance at within the desired range. By maintaining the distance of the cutter head axis within preselected limits the steering system is in effect maintaining the current position of the cutter head axis within a preselected distance range with respect to the mine floor (upon which the conveyor rests) formed during previous traverses of the machine along the face. Thus, the steering control means is able to take account of all the sensed and monitored parameters to maintain the cutter head at a desired cutting horizon with respect to the previously formed mine floor.

We claim:

1. A mining machine adapted to traverse on an armored face conveyor, said machine comprising:

a body adapted to move on a track fixed with respect to the conveyor;

a cutter head;

an arm pivotably mounted on the body for movement about an axis, said arm supporting said cutter head remote from said axis; and a sensor carried on said arm for sensing the distance between the cutter head and the conveyor and for deriving a signal indicative of the distance, said sensor being engagable with the conveyor and comprising a telescopic assembly including a piston and cylinder arrangement and resilient biasing means for urging said arrangement toward engagement with the conveyor, said sensor further comprising a potentiometer arranged to sense variation in the effective length of the telescopic assembly and to derive said signal indicative to the sensed variation, which derived signal is fed to a steering mechanism of the machine.

2. A machine as claimed in claim 1, in which the cutter head is a rotary cutter head and the sensor senses the distance between the axis of rotation of the rotary cutter head and the conveyor.

3. A machine as claimed in claim 2, in which the sensor includes a base pad slidable on the conveyor.

4. A machine as claimed in claim 1, in which the potentiometer is mounted within the piston and cylinder arrangement.

5. A machine as claimed in claim 4, in which the potentiometer is mounted between two attachment elements and is electrically connected to a circuit board assembly with the telescopic assembly.

* * * * *